US005620313A

United States Patent [19]

Fockenberg

[11] Patent Number: 5,620,313

[45] Date of Patent: Apr. 15, 1997

[54] WORM PUMP FOR FLOWABLE MEDIA

[75] Inventor: Klemens Fockenberg, Bottrop, Germany

[73] Assignee: Seepex Seeberger GmbH & Co., Bottrop, Germany

[21] Appl. No.: 587,668

[22] Filed: Jan. 17, 1996

[30] Foreign Application Priority Data

Jan. 19, 1995 [DE] Germany ..... 195 01 441.3

[51] Int. Cl.[6] ..... F04B 43/12

[52] U.S. Cl. ..... 417/475; 417/477.4

[58] Field of Search ..... 417/475, 477.4; 418/45, 153, 220

[56] References Cited

U.S. PATENT DOCUMENTS

| | | | |
|---|---|---|---|
| 2,621,605 | 12/1952 | Mark, Jr. | 417/477.4 |
| 2,629,333 | 2/1953 | Olden | 417/477.4 |
| 2,752,860 | 7/1956 | Waldin | 417/477.4 |
| 3,340,817 | 9/1967 | Kemnitz | 417/475 |
| 3,951,576 | 4/1976 | Lofquist, Jr. | 418/45 |

FOREIGN PATENT DOCUMENTS

| | | | |
|---|---|---|---|
| 2004850 | 12/1993 | Russian Federation | 418/45 |
| 800154 | 8/1958 | United Kingdom | 418/45 |

*Primary Examiner*—John J. Vrablik
*Attorney, Agent, or Firm*—Herbert Dubno

[57] ABSTRACT

A worm pump has an eccentric worm rotor rotatable in a stator to compress tubes which thus carry respective flowable media so that these media are forced through the tubes. The tubes are received in recesses in the stator wall which preferably is composed of a rubber with a shore A hardness of 90 to 95.

10 Claims, 4 Drawing Sheets

WORM PUMP FOR FLOWABLE MEDIA

FIELD OF THE INVENTION

My present invention relates to a worm pump for a flowable medium of the type which uses a rotor having the form of a worm and which is eccentrically driven. The pump is suitable for the displacement of any flowable medium, especially liquids and particularly viscous liquids, suspensions, slurries or the like.

BACKGROUND OF THE INVENTION

Worm pumps using rotors which have the configuration of a helix, i.e. a screw configuration and of a uniform circular cross section over the pumping length of the worm with the circular cross section being offset from the axis of rotation of the eccentric worm rotor by a certain eccentricity, are known. The rotor is displaceable in a stator chamber and generally the pump medium flows directly through this chamber being displaced by the rotation of the pump. Worm pumps of this type are described by Hartinger, Taschenbuch der Abwasserbehandlung, Band 2, Carl Hanser Verlag, 1977 (Handbook of Sewage Treatment, Volume 2, Carl Hanser Publishing, 1977). In such pumps the stator generally has screw-like recesses with twice the pitch and number of helices as the eccentric worm rotor. The rotation axis of the eccentric worm rotor and the longitudinal axis of the stator chamber are offset by the eccentricity of the eccentric worm rotor.

This pump has been found to be expensive to fabricate and the drive system for the pump is relatively complex and expensive as well. Since the motion is relatively complex, reliability is often in question. The pump stator, against which the rotor must seal directly, is subject to considerable wear. The materials from which the pump stator and the rotor are made must be determined based upon resistance to attack by the material pumped. The prior art pump, moreover, can be traversed by only one liquid stream, i.e. per rotor/stator pair only a single flowable substance can be displaced.

OBJECTS OF THE INVENTION

It is the principal object of the present invention to eliminate all of these drawbacks.

Another object of the invention is to provide a worm pump which has a comparatively simple construction but nevertheless can be used for pumping more than one flowable material.

Another object of the invention is to provide an improved worm pump which eliminates the possibility of corrosive and other attack by the pumped media upon the stator and rotor material.

Still another object of the invention is to provide a worm pump which is easier to manufacture and drive than earlier worm pumps.

In general it is an object of this invention to provide an improved worm pump free from drawbacks of earlier systems.

SUMMARY OF THE INVENTION

These objects and others which will become apparent hereinafter are attained, in accordance with the invention, by forming the stator chamber with a longitudinally extending part cylindrical stator wall segment a radius which is matched, with limited play or tolerance to the sum of the eccentricity and cross section radius of the worm and by providing the rotation axis of the rotor and the longitudinal axis of the stator so that they coincide. The worm, of course, has a uniform circular cross section over its pumping length with the centers of these cross sections being offset by the eccentricity from the rotation axis of the rotor. According to a feature of the invention, the stator chamber is provided with at least two longitudinally extending recesses in which respective elastic tubes or hoses are received and which project into the stator chamber. The tubes or hoses are compressed by the surfaces of the rotor most distal from the rotation axis so that between these compression zones which correspond to sealing zones of the tubes which advance therealong, the tubes form pockets receiving the flowable medium so that the flowable medium is thus displaced along the tubes from end to end by rotation of the rotor.

The pump of the invention operates in effect as a linear peristaltic pump with the compression zone being advanced along each tube from one end of the worm to the other, thereby displacing the medium along the tube.

The invention is based upon the fact that, in spite of the open screw-shaped passage between the eccentric worm rotor and the partly cylindrical stator wall segments, displacement of a flowable medium can be effected by rotation of the rotor by confining the flow of the medium within elastic tubes or hoses partly received in the longitudinal recesses. Between the tubes and the rotor on the one hand and the stator on the other, there is progressively advancing compression which can seal the cross section of the tube and advance the sealed cross section therealong. However, there is no wear between the rotor or the stator surfaces.

When two or more tubes are used, the pump can displace two or more flowable media through the respective tubes although it is advantageous, in accordance with the invention, for two diametrically opposite tubes to have the same dimensions and to displace the same flowable medium through them.

The pump stator and the eccentric worm rotor operate practically wear-free and without problems of corrosion or abrasion since the tubes separate with respective media to one another and from both the walls of the stator and the walls of the rotor.

The worm pump thus can comprise:

an elongated rotor rotated about an axis and in the form of a worm, the rotor being of uniform circular cross section along a length thereof with the centers of the cross sections being offset from the axis of rotation of the rotor;

a pump stator formed with a stator cavity receiving the rotor and defined by a plurality of angularly spaced cylindrical wall segments defining a clearance with the rotor and of a radius greater by the clearance than a sum of a radius of the circular cross section and the offset of the centers from the axis of rotation, the stator cavity comprising at least two longitudinal recesses between the wall segments, the stator cavity having a longitudinal axis coinciding with the axis of rotation of the rotor; and respective elastic tubes received in the recesses and projecting therefrom into the stator cavity for compression by portions of the rotor furthest from the axis of rotation, thereby advancing squeezed sealing regions of the respective tubes axially therealong to displace a flowable medium in the respective tube.

The displacement of a pumpable material by advancing the compression zone of a tube is disclosed, for example, in Ullmanns Encyklopädie der technischen Chemie, 1973, Vol. 3, page 169.

In this system, however, the tube is engaged by a plurality of compression bodies like rollers or compression shoes which slide along the tube, the formation of a pump which can displace a number of flowable media simultaneously requires multiplication of the number of such bodies or compression members and this may be expensive. Furthermore, by sliding or rolling the members along the length of the tube there is a tendency for the tube to elongate and for the characteristics of the tube to change. With the worm pump of the invention there is no yielding of the tube in the longitudinal direction since frictional forces are applied between the rotor and the tube essentially only in the peripheral direction.

Furthermore, with the worm pump of the invention, the pitch of the rotor determines the angle of the seal line to the displacement direction and ensures that the seal line will not be exactly perpendicular to this direction, thereby reducing a tendency for the displacement to pulsate. The flow of the pumped medium is therefore especially smooth and free from pulsation.

According to the invention the rotor can have more than one helix. The number of sealing locations along each elastic tube can thus be increased for a stator of a given length and enables the pressure generated to be increased.

While the pump stator and, particularly, the structure defining the stator cavity, can be composed of any material since there need be no concern over corrosion thereof, I have found it to be advantageous to the life of the elastic tubes to utilize an elastic material also for the stator wall and particularly an elastic material with a hardness between 90 and 95 Shore A.

For a uniform low-pulsation operation of the worm pump it has also been found to be advantageous to distribute the recesses and elastic tubes in angularly equispaced relationship about the periphery of the stator chamber.

When different media are displaced through the elastic tubes, it is preferred to pump the same material through those tubes which lie diametrically opposite one another, i.e. to pass the different media through the tubes in a pair-wise manner. The outflow from the diametrically opposite tubes can be combined at the downstream end to ensure a feed of each medium with particularly low pulsation.

According to another feature of the invention, elastic tubes of different diameters are received in the recesses. This allows different rates of displacement of the media in the individual tubes. The ratios of the volumetric displacements of the media is independent of the speed and pitch of the eccentric worm rotor and of the total volume displaced. The pump of the invention can therefore be utilized for metering purposes, for mixing of different media and like control applications, eliminating the need for individual pumps to control the amounts fed of different media.

Of course the chambers can be modified as to depth and width to suit the different tube diameters used. As a general proposition it is not required for the same wall thickness for tubes of different diameters or to vary the wall thickness as a function of the diameter of the tube. Of course the sum of the depth of the recess and the play or tolerance should be matched to twice the wall thickness of the tube received in the chamber for effective sealing.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
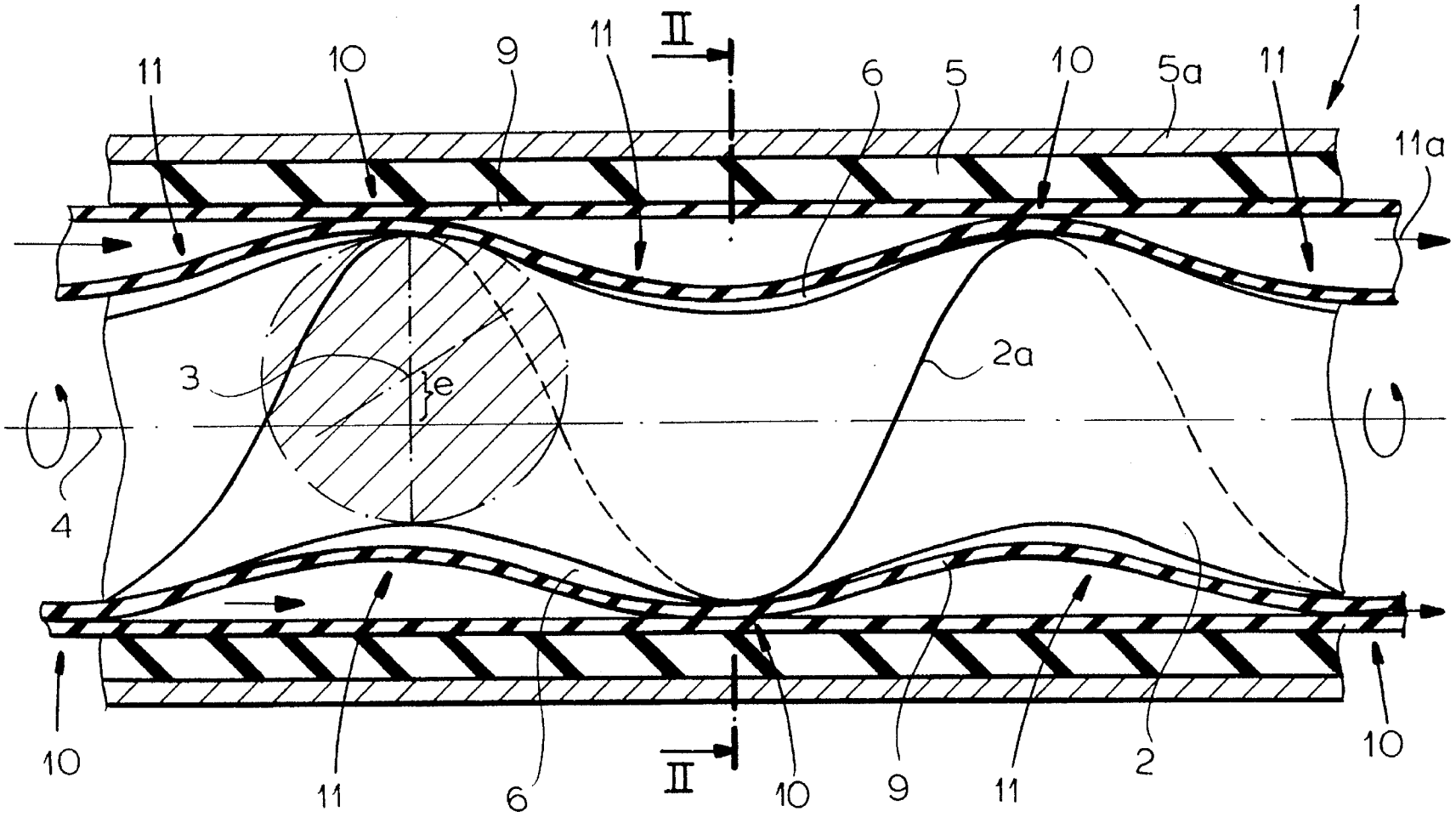
FIG. 1 is an axial section through a worm pump according to the invention having an eccentric worm rotor, pump stator and a plurality of elastic tubes.
Figure 2:
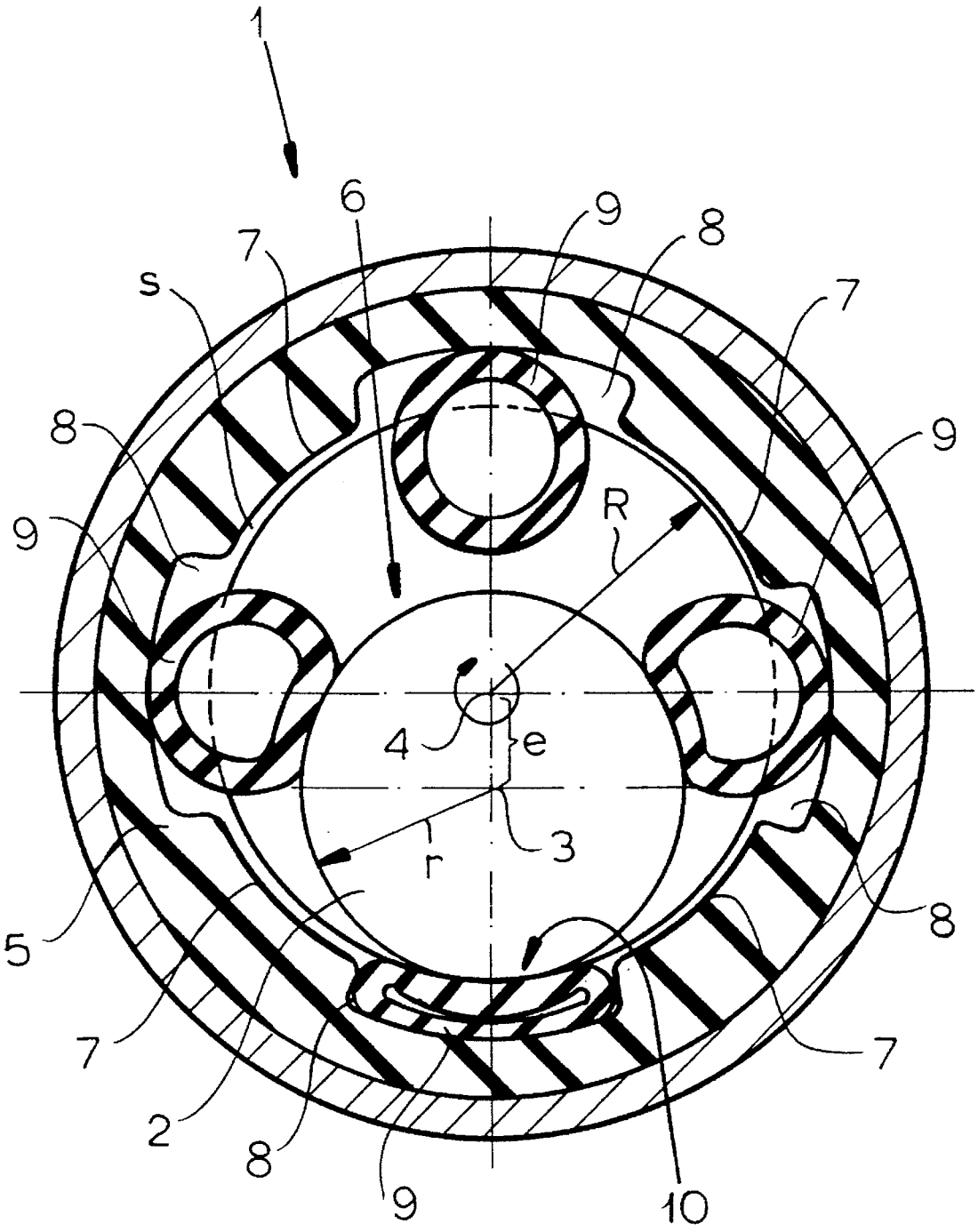
FIG. 2 is a section taken along the line II—II of FIG. 1.

The device shown in FIGS. 1 and 2 is a worm pump for viscous materials such as suspensions, slurries, viscous solutions and the like. The details of the drive, the journaling of the eccentric worm rotor, the seals for bearings thereof, the means for supplying and carrying off the pumped media have not been illustrated.

Basically the worm pump comprises a screw-shaped driven eccentric worm rotor 2. In dot-dash lines circular cross section of the rotor, which is constant over the pumping length thereof, has been illustrated. The center points of the circular cross sections 3 are offset by a distance e, also referred to as the eccentricity.

The rotor is rotatable in a chamber of a pump stator 5 which is composed of a NBR rubber and can be reinforced by a metal shell 5*a*. The cavity within the stator is represented at 6 and receives the eccentric worm rotor.

A comparison of FIGS. 1 and 2 shows that the stator cavity 6 has longitudinally extending, partially cylindrical stator wall segments 7. FIG. 2 shows a tolerance or play s between the eccentric worm rotor 2 and the pump stator 5 which ensures a wear-free relative movement of these two parts.

The radius R of the stator segments 7 corresponds to the sum of the play s, the cross section radius r of the rotor 2 and the eccentricity e as will be apparent especially from FIG. 2. The eccentricity e amounts to 23% of the diameter of the eccentric worm rotor in the best mode embodiment of the invention. The axis of rotation 4 of the worm 2 coincides with the longitudinal axis of the stator cavity 6 and thus a centric drive can be provided for the eccentric worm rotor in alignment with the axis 4.

As is also apparent from FIG. 2, the stator cavity 6 has four recesses 8 in angularly equispaced relationship. These recesses extend, as will be apparent from FIG. 1, in the longitudinal direction over the full length of the stator. The stator wall segments 7 lie between the recesses 8. The recesses 8 receive elastic tubes or hoses 9. The embodiment of FIG. 2 is a four-flow worm pump which can displace a respective flowable medium through each of the four tubes.

As can be seen from FIGS. 1 and 2, the portions of the eccentric worm rotor 2 most remote from the axis of rotation 4 describe a helical path represented by the line 2*a*. The regions most distal from the axis can compress the tubes until the tubes are forced shut as has been shown, for example, at the sealing regions 10. Between the sealing regions, displacement chambers 11 are formed and these displacement chambers are advanced in the direction of arrow 11*a* as the worm is rotated. The sealing line 2*a* between the eccentric worm rotor 2 and the tubes 9 has a pitch corresponding to the pitch of the worm and a pitch angle which depends upon the pitch.

The eccentric worm rotor 2 of FIG. 1 is a single helix worm. A double helix worm has been shown in FIG. 3. The eccentric worm rotor 2 is normally composed of steel while the tubes 9 are composed of an elastomeric plastic or rubber. With respect to the stator 5, it has been found that a material with a Shore A hardness of 90 to 95 is most desirable.

Because the pumped media are confined to the tubes 9, there is no danger of chemical attack on the eccentric worm rotor or the stator, so that economical materials can be used for these elements.

As FIG. 2 shows, the tubes 9 are disposed equidistantly about the periphery of the stator chamber and, when two different pumped media are provided, it is advantageous to feed one through one pair of diametrically opposite tubes 9 while the other medium is fed through the other pair of diametrically opposite tubes.

In the embodiment of FIGS. 1 and 2, the tubes 9 are all of the same diameter and thus displace the same flow rates.

Figure 3:
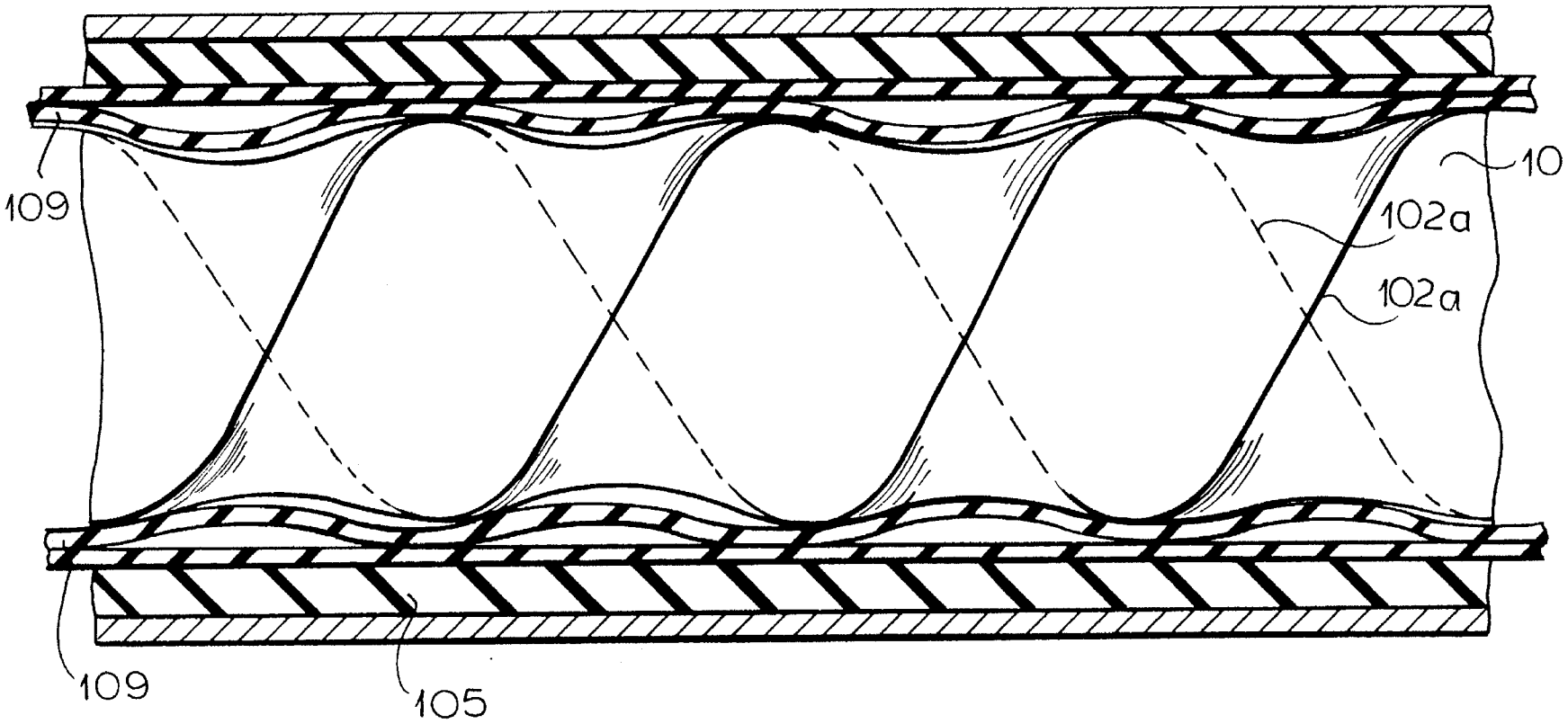
FIG. 3 is a view similar to FIG. 2 but showing an eccentric worm rotor having a double helix or thread.

In FIG. 3 I have shown a system in which the stator 105 receives tubes 109 in the manner previously described and the worm 102, but here a double helix screw is used with the two helixes being represented by the lines 102*a*. They are thus 180° offset from one another.

Figure 4:
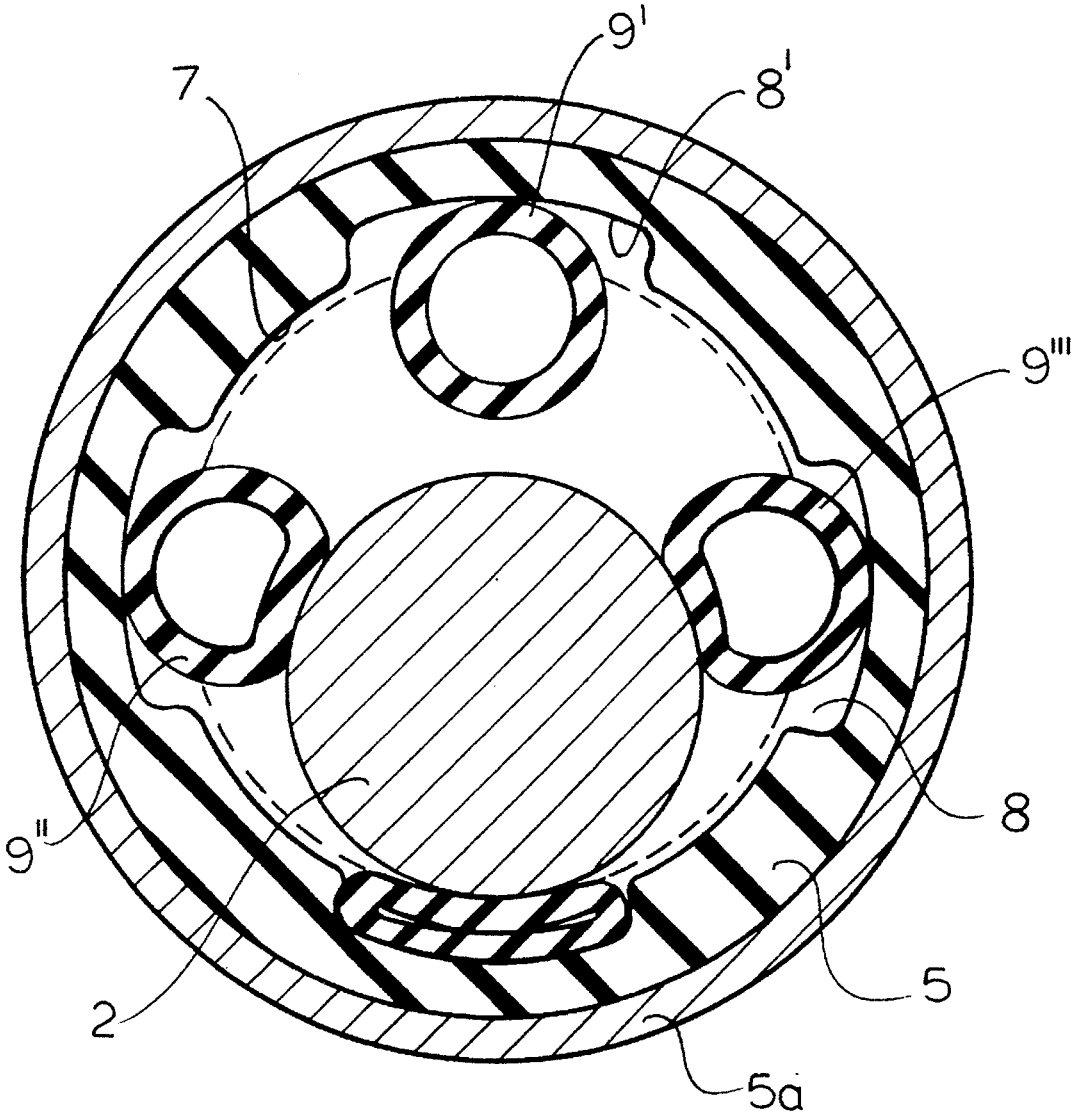
FIG. 4 is a cross sectional view generally similar to FIG. 2 but showing a pump in which tubes of different diameters are provided.

FIG. 4 shows that the recesses 8, 8', etc in the stator 5 can be of different dimensions to accommodate different diameters of the tubes 9', 9", 9'''. The ratios between the various media which pass through the tubes remains constant and is independent of the total throughput, the rotary speed and the pitch of the eccentric worm rotor.

I claim:

1. A worm pump comprising:

an elongated rotor rotated about an axis and in the form of a worm, said rotor being of uniform circular cross section along a length, thereof with the centers of the cross sections being offset from said axis of rotation of the rotor;

a pump stator formed with a stator cavity receiving said rotor and defined by a plurality of angularly spaced cylindrical wall segments defining a clearance with said rotor and of a radius greater by said clearance than a sum of a radius of the circular cross section and the offset of said centers from said axis of rotation, said stator cavity comprising at least two longitudinal recesses between said wall segments, said stator cavity having a longitudinal axis coinciding with said axis of rotation of the rotor; and respective elastic tubes received in said recesses and projecting therefrom into said stator cavity for compression by portions of said rotor furthest from said axis of rotation, thereby advancing squeezed sealing regions of the respective tubes axially therealong to displace a flowable medium in the respective tube, said tubes in said recesses being of different diameters.

2. The worm pump defined in claim 1 wherein said recesses are angularly equispaced around said axis of the stator cavity.

3. The worm pump defined in claim 1 wherein said tubes include a pair of opposite tubes charged with the same flowable medium.

4. The worm pump defined in claim 1 wherein said rotor is a multiple-helix worm.

5. The worm pump defined in claim 4 wherein said stator is composed of an elastic material with a Shore A hardness of 90 to 95.

6. The worm pump defined in claim 5 wherein said recesses are angularly equispaced around said axis of the stator cavity.

7. The worm pump defined in claim 1 wherein said stator is composed of an elastic material with a Shore A hardness of 90 to 95.

8. The worm pump defined in claim 7 wherein said recesses are angularly equispaced around said axis of the stator cavity.

9. A worm pump comprising:

an elongated rotor rotated about an axis and in the form of a worm, said rotor being of uniform circular cross section along a length thereof with the centers of the cross sections being offset from said axis of rotation of the rotor;

a pump stator formed with a stator cavity receiving said rotor and defined by a plurality of angularly spaced cylindrical wall segments defining a clearance with said rotor and of a radius greater by said clearance than a sum of a radius of the circular cross section and the offset of said centers from said axis of rotation, said stator cavity comprising at least two longitudinal recesses between said wall segments, said stator cavity having a longitudinal axis coinciding with said axis of rotation of the rotor; and respective elastic tubes received in said recesses and projecting therefrom into said stator cavity for compression by portions of said rotor furthest from said axis of rotation, thereby advancing squeezed sealing regions of the respective tubes axially therealong to displace a flowable medium in the respective tube, said stator being composed of an elastic material with a Shore A hardness of 90 to 95, said recesses being angularly equispaced around said axis of the stator cavity, said tubes including a pair of opposite tubes charged with the same flowable medium, said tubes in said recesses being of different diameters.

10. A worm pump comprising:

an elongated rotor rotated about an axis and in the form of a worm, said rotor being of uniform circular cross section along a length thereof with the centers of the cross sections being offset from said axis of rotation of the rotor;

a pump stator formed with a stator cavity receiving said rotor and defined by a plurality of angularly spaced cylindrical wall segments defining a clearance with said rotor and of a radius greater by said clearance than a sum of a radius of the circular cross section and the offset of said centers from said axis of rotation, said stator cavity comprising at least two longitudinal recesses between said wall segments, said stator cavity having a longitudinal axis coinciding with said axis of rotation of the rotor; and respective elastic tubes received in said recesses and projecting therefrom into said stator cavity for compression by portions of said rotor furthest from said axis of rotation, thereby advancing squeezed sealing regions of the respective tubes axially therealong to displace a flowable medium in the respective tube, said rotor being a multiple-helix worm, said stator being composed of an elastic material with a Shore A hardness of 90 to 95, said recesses being angularly equispaced around said axis of the stator cavity, said tubes including a pair of opposite tubes charged with the same flowable medium, said tubes in said recesses being of different diameters.

* * * * *